US009452862B2

(12) United States Patent
Liu et al.

(10) Patent No.: US 9,452,862 B2
(45) Date of Patent: Sep. 27, 2016

(54) MULTI-PIECE BOX BASE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Hai Liu, Shenzhen (CN); Yu-Hua Wu, Shenzhen (CN); Ming-Chang Lee, New Taipei (TW)

(73) Assignees: HONG FU JIN PRECISION INDUSTRY (SHenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 60 days.

(21) Appl. No.: 14/449,772

(22) Filed: Aug. 1, 2014

(65) Prior Publication Data

US 2015/0041463 A1 Feb. 12, 2015

(30) Foreign Application Priority Data

Aug. 6, 2013 (CN) ..... 2013 1 03387562

(51) Int. Cl.

| | |
|---|---|
| ***B65D 6/24*** | (2006.01) |
| ***B65D 6/00*** | (2006.01) |
| ***B65D 6/16*** | (2006.01) |

(52) U.S. Cl.

CPC ..... *B65D 11/20* (2013.01); *B65D 11/18* (2013.01)

(58) Field of Classification Search

CPC ..... B65D 11/18; B65D 11/20; B65D 11/188; B65D 11/184; B65D 7/26

USPC ..... 220/4.24, 4.28, 4.29, 6, 7, 666, 676, 220/677; 206/600

See application file for complete search history.

(56) References Cited

U.S. PATENT DOCUMENTS

| | | | | |
|---|---|---|---|---|
| 2009/0145339 | A1 | 6/2009 | Dubois et al. | |
| 2012/0234844 | A1* | 9/2012 | Hug | B65D 11/1853 220/720 |

FOREIGN PATENT DOCUMENTS

| | | | |
|---|---|---|---|
| CN | 2578242 | Y | 10/2003 |
| CN | 201002756 | Y | 1/2008 |
| CN | 202144326 | U | 2/2012 |
| TW | M441637 | U1 | 11/2012 |

* cited by examiner

*Primary Examiner* — Fenn Mathew
*Assistant Examiner* — Elizabeth Volz
(74) *Attorney, Agent, or Firm* — Zhigang Ma

(57) ABSTRACT

A multi-piece box base includes at least two base members releasably attached to each other. Each base member includes three upright sides and a flat bottom wall from which, in an alternating manner, bars extend and in which recesses are defined. The bars of one bottom wall meet and interlock with the recesses of the bottom wall of the second, opposing, base member and fasteners are used to strengthen the structural connections between bars and recesses.

6 Claims, 5 Drawing Sheets

MULTI-PIECE BOX BASE

FIELD

The subject matter herein generally relates to container structures.

BACKGROUND

A base of a box is made by a plurality of pieces and usually integrally formed which occupies space in storage.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
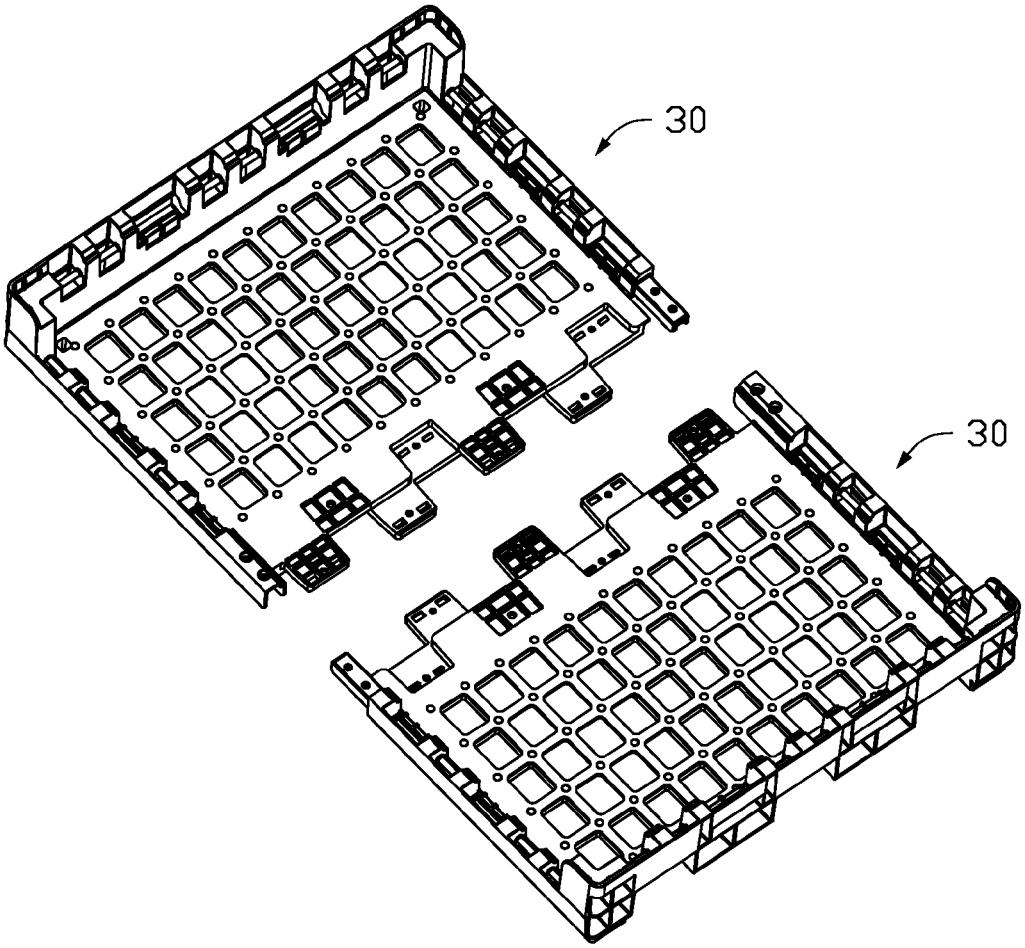
FIG. 1 is an exploded, isometric view of an embodiment of a box base, including a pair of base members.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure describes a base of multi-piece box.

FIG. 1 illustrates an embodiment of a box base. The box base includes a pair of base members 30.

Figure 2:
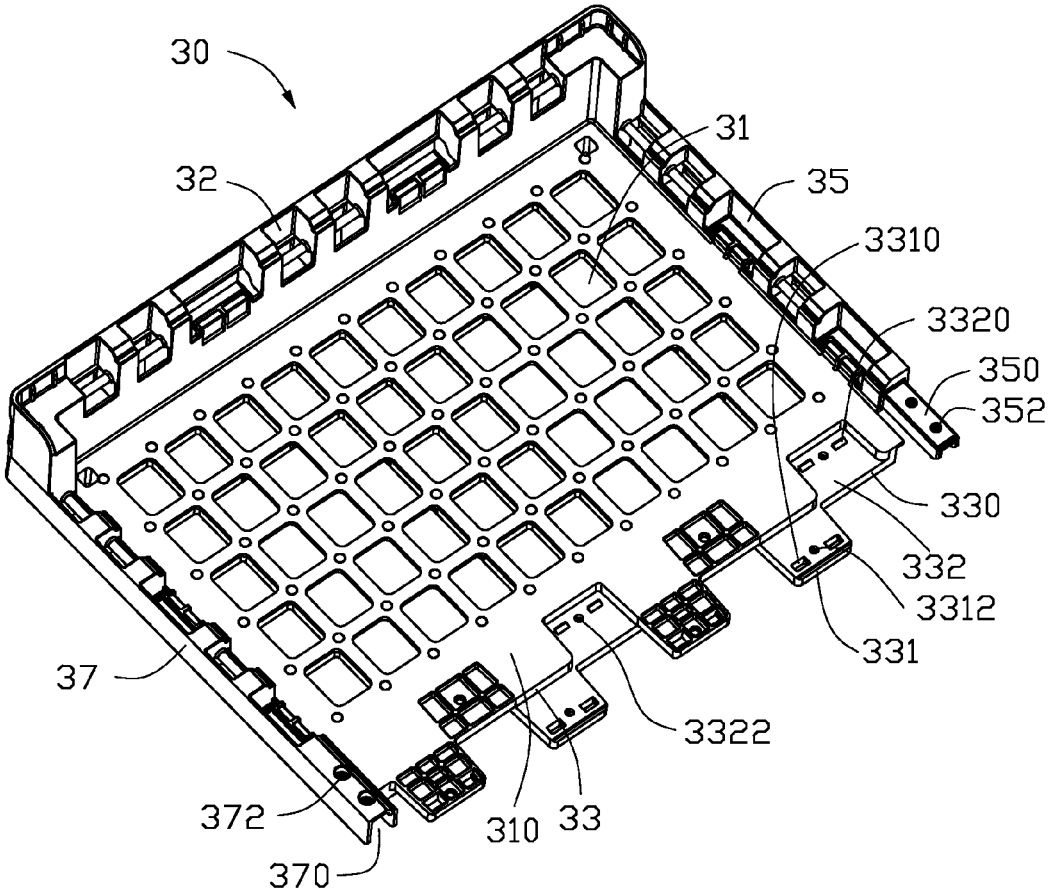
FIG. 2 is an enlarged, isometric view of the box base member of FIG. 1.
Figure 3:
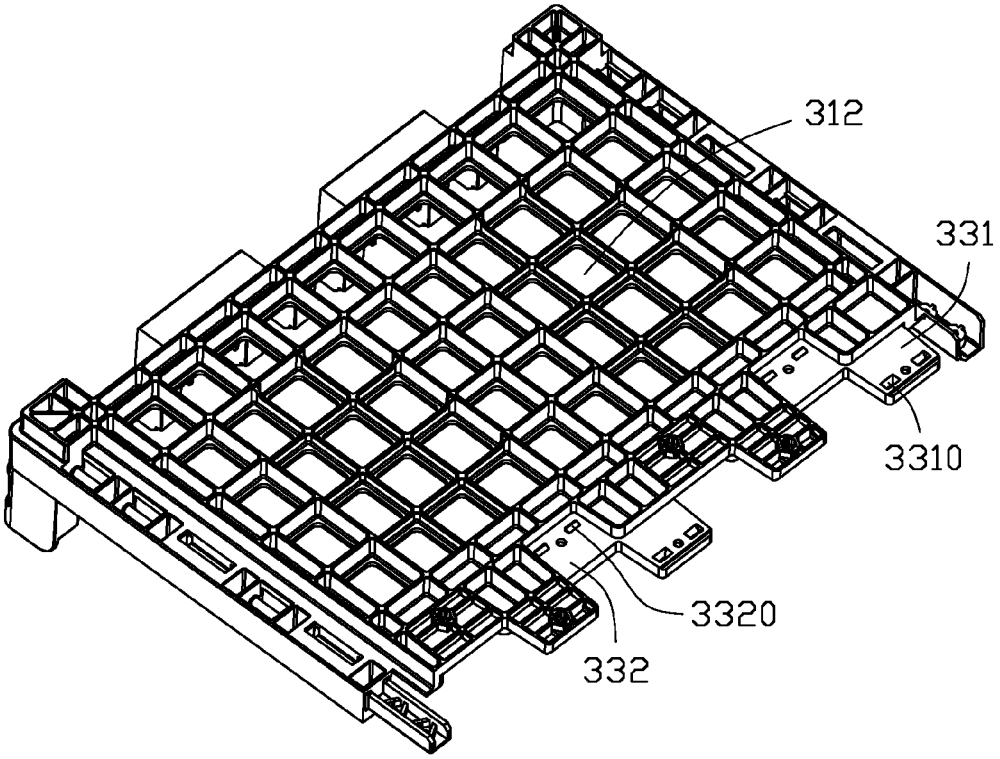
FIG. 3 is similar to FIG. 2, but viewed from another angle.

FIGS. 2 and 3 illustrate that each base member 30 includes a substantially rectangular bottom wall 31, an end wall 32 extending perpendicularly from one end edge of the bottom wall 31, and a first sidewall 35 and a second sidewall 37 extending perpendicularly from the opposite side edges of the bottom wall 31 and coupled to the end wall 32.

The bottom wall 31 includes a first surface 310 and a second surface 312 opposite to the first surface 310. Spaced bars 331 extend, in an alternating manner, from the first surface 310 and from the second surface 312 of the bottom wall 31. A plurality of spaced recessed portions 332, in the same alternating manner, are defined in the first surface 310 and in the second surface 312 of the bottom wall 31. Each of the bars 331 is configured to meet, and interlock with a recessed portion 332. Each bar 331 includes a pair of latching holes 3310 defined in an end thereof away from the end edge 330 and a screw hole 3312 defined between the two latching holes 3310. Each recessed portion 332 includes a pair of latches 3320 extending from an end thereof away from the end edge 330 and a through hole 3322, defined between the two latches 3320, to accommodate a screw (not shown).

A first extension member 350 extends from an end of the first sidewall 35 away from the end wall 32. A second extension member 370 extends from an end of the second sidewall 37 away from the end wall 32. The second extension member 370 is configured to slidably receive the first extension member 350. A pair of through holes 372 is defined in the second extension member 370 and a pair of screw holes 352 is defined in the first extension member 350. The first extension portion 350 and the second extension portion 370 have U-shaped cross-sections.

Figure 4:
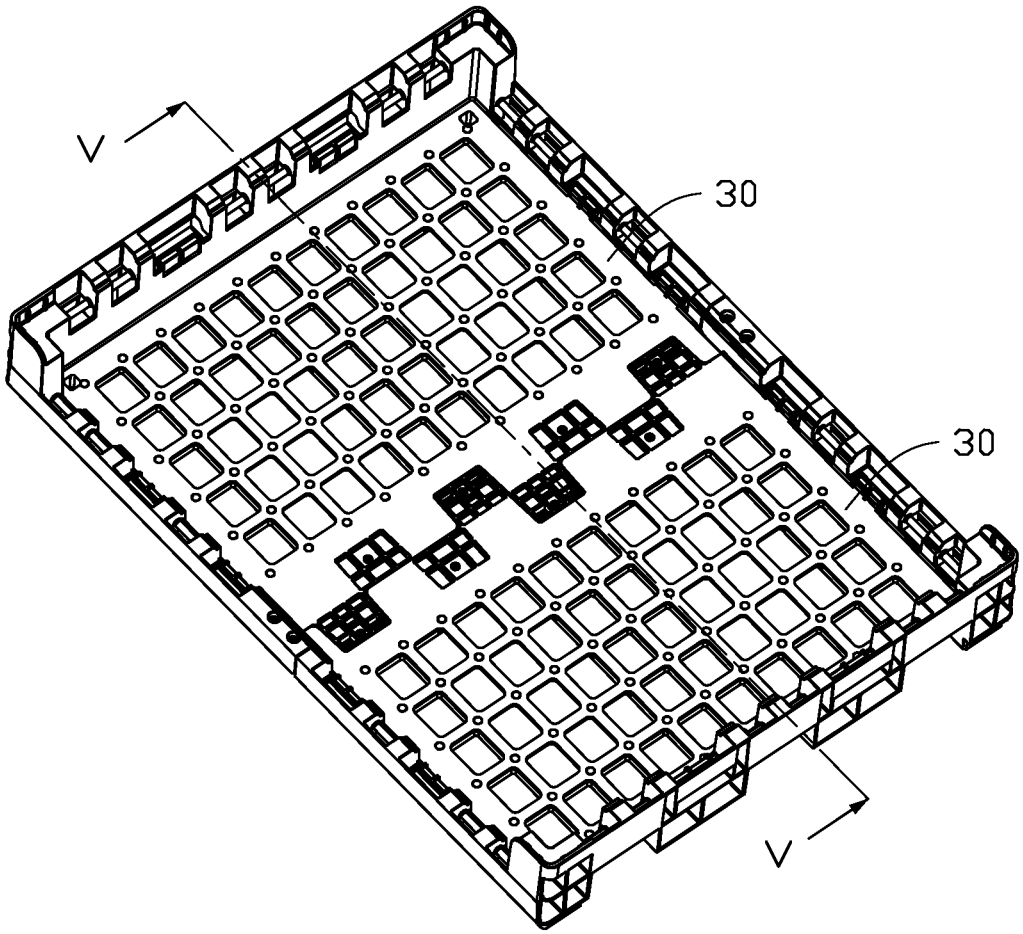
FIG. 4 is an assembled, isometric view of the box base of FIG. 1.
Figure 5:
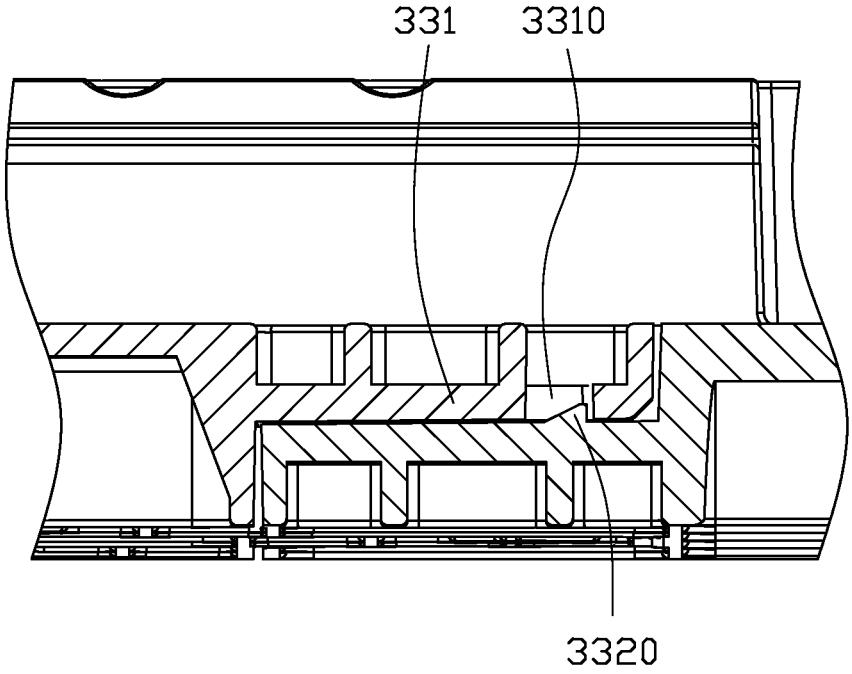
FIG. 5 is a cross-sectional view along the line V-V of FIG. 4.

FIG. 4 and FIG. 5 illustrate assembly, whereby the two connection portions 33 of the two base members 30 are placed opposite each other. The first extension portions 350 are slidably received in the second extension portions 370 and the through holes 352 are aligned with the screw holes 372. The recessed portions 332 receive the bars 331, and the through holes 3322 are in alignment with the screw holes 3312. A pair of fasteners extend through the through holes 3322 to engage the screw holes 3312, and a plurality of fasteners extends through the through holes 352 to engage the screw holes 372. Thus, the base is assembled.

The two base member 30 are latched together to form the box base, the components of the box base having a small storage size.

It is to be understood, however, that even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A multi-piece box base comprising:

at least two base members releasably latched to each other, wherein each base member comprises a bottom wall, the bottom wall comprises opposite first surface and second surface, a plurality of spaced bars extend from the first surface and the second surface of the bottom wall in an alternating manner, a plurality of spaced recessed portions defined in the first surface and the second surface of the bottom wall in an alternating manner, a pair of latching holes is defined in each bar, a pair of latches is formed at each recessed portion, the bars of one base member are received in the recessed portions of the other base member, the latches of one base member engage in the latching holes of the other base member, and wherein a first sidewall and a second sidewall perpendicularly extend from two opposite side edges of the bottom wall, a first extension member extends from an end of the first sidewall near the end edge of the bottom wall, a second extension member extends from an end of the second sidewall near the end edge of the bottom wall, the second extension member of one base member is slidably received in the first extension member of the other base member.

2. The multi-piece box base of claim 1, wherein the bars and the recessed portions of each base member are interlocked.

3. The multi-piece box base of claim 1, wherein a pair of through holes is defined in the first extension member, a pair of screw holes is defined in the second extension member, a pair of fasteners extends through the through holes to engage in the screw holes.

4. The multi-piece box base of claim 1, wherein each of the first extension portion and the second extension portion has a U-shaped cross section.

5. The multi-piece box base of claim 1, wherein the pair of latches is formed at an end of the bar away from the end edge of the bottom wall, the pair of the latching holes are defined in an end of the recessed portion away from the end edge of the bottom wall.

6. The multi-piece box base of claim 5, wherein a screw hole is defined between the two latching holes of each bar, a through hole is defined between the two latches of each recessed portion.

* * * * *